US005703610A

United States Patent [19]

Kishino et al.

[11] Patent Number: 5,703,610

[45] Date of Patent: Dec. 30, 1997

[54] DRIVE CIRCUIT FOR IMAGE DISPLAY DEVICE

[75] Inventors: Takao Kishino; Koji Onodaka; Mitsuru Tanaka; Satoshi Yamaguchi, all of Mobara, Japan

[73] Assignee: Futaba Denshi Kogyo K.K., Mobara, Japan

[21] Appl. No.: 609,348

[22] Filed: Mar. 1, 1996

[30] Foreign Application Priority Data

Mar. 3, 1995 [JP] Japan ..... 7-068987

[51] Int. Cl.[6] ..... G09G 3/22

[52] U.S. Cl. ..... 345/74; 313/495; 313/496

[58] Field of Search ..... 345/74, 75; 313/495, 313/496, 497

[56] References Cited

U.S. PATENT DOCUMENTS 5,600,203 2/1997 Namikawa et al. ..... 313/495

5,608,285 3/1997 Vickers et al. ..... 313/496

*Primary Examiner*—Mark R. Powell

*Assistant Examiner*—Matthew Luu

*Attorney, Agent, or Firm*—Oblon, Spivak, McCelland, Maier & Neustadt, P.C.

[57] ABSTRACT

A drive circuit for an image display device capable of permitting anode lead-out wires to be led out without using a three-dimensional wiring structure and an image free of color bleeding to be displayed. Two-divided first and second anode electrodes are arranged opposite to stripe-like gate electrodes and are alternately driven. During driving of the first anode electrodes, cathode electrodes are scanned and only gate electrodes opposite to the anode electrodes are fed with image data. Then, the second anode electrodes are driven and scanning is likewise carried out. Thus, an image for one frame is displayed. Electrodes arranged on both sides of each of the anode electrodes and gate electrodes in a manner to be adjacent thereto have a potential kept at a ground level.

3 Claims, 13 Drawing Sheets

FIG.8(a) ANODE A1 CATHODE C1
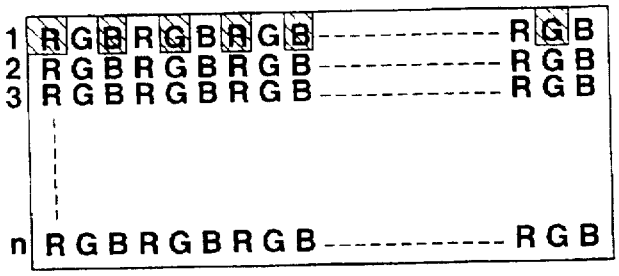
FIG.8(b) ANODE A1 CATHODE C2
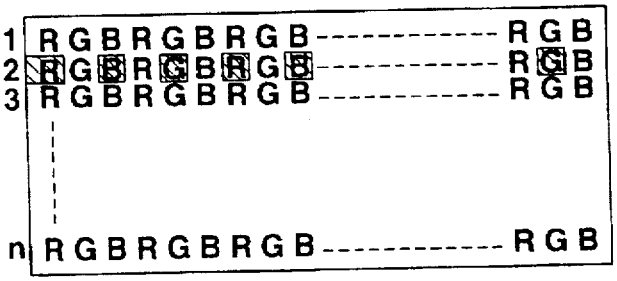
FIG.8(c) ANODE A2 CATHODE C1
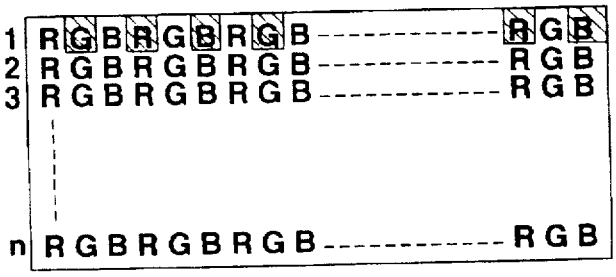
FIG.8(d) ANODE A2 CATHODE C2
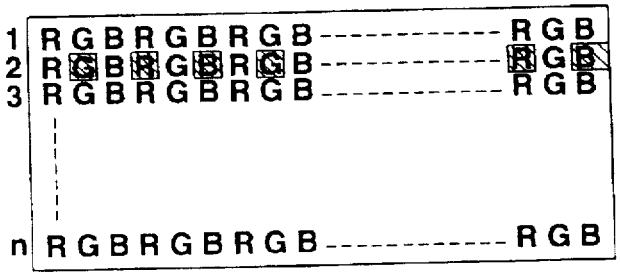

SHIFT REGISTER
LATCH
GATE DRIVER
FED (m×n MATRIX)
ANODE DRIVER
CATHODE DRIVER
LATCH
SHIFT REGISTER
DATA
SCLK
ENABLE
LATCH
A-CONT
BUFFER
BUFFER
BUFFER
ADDRESS COUNTER
COLOR SELECTION CIRCUIT
DISPLAY TIMING CONTROL CIRCUIT
FRAME MEMORY OR LINE MEMORY
CLOCK GENERATOR
MEMORY WRITE CONTROL CIRCUIT
SYNCHRONOUS SIGNAL
IMAGE DATA

DRIVE CIRCUIT FOR IMAGE DISPLAY DEVICE

BACKGROUND OF THE INVENTION

This invention relates to a drive circuit for an image display device, and more particularly to a drive circuit suitable for use for an image display device having a field emission cathode incorporated therein.

When an electric field set at about $10^9$ (V/m) is applied to a surface of a metal material or that of a semiconductor material, a tunnel effect permits electrons to pass through a barrier, resulting in the electrons being discharged to a vacuum even at a normal temperature. Such a phenomenon is referred to as "field emission" and a cathode constructed so as to emit electrons based on such a principle is referred to as "field emission cathode".

Recent development of semiconductor processing techniques permits a field emission cathode (hereinafter also referred to as "FEC") structure of the surface emission type to be formed of a field emission cathode array of a size as small as microns.

Now, a conventional FEC called a Spindt-type cathode will be described hereinafter with reference to FIGS. 11(*a*) and 11(*b*) by way of example, wherein FIG. 11(*a*) is a perspective view showing an FEC manufactured by means of fine processing techniques for a semiconductor and FIG. 11(*b*) is a sectional view taken along line A—A of FIG. 11(*a*).

The conventional FEC includes a substrate 101, on which cathode electrodes 102 are formed by deposition or the like. The cathode electrodes 102 each are formed thereon with emitters 105 of a conical shape. Also, the cathode electrodes each are provided thereon with a gate electrode 104 through an insulating layer 103 made of silicon dioxide ($SiO_2$). The conical emitters 105 each are positioned in each of circular holes formed through each of the gate electrodes 104.

This permits each of the emitters 105 to be exposed at a distal end thereof from each of the through-holes of the gate electrode 104.

The conventional techniques permit the conical emitters 105 to be arranged at a pitch as small as 10 microns or less, so that tens of thousands to hundreds of thousands of emitters may be provided on one substrate.

Also, the conventional techniques permit a distance between the gate electrode 104 and the distal end of each of the emitters 105 to be less than a micron, so that application of a voltage as low as tens of volts between the gate electrode 104 and the cathode electrode 102 leads to field emission of electrons from the emitters 105.

Also, the FEC may be constructed into a surface-emission type structure as shown in FIGS. 11(*a*) and 11(*b*). Application of such a surface-emission type FEC to a flat-type color display device was proposed as disclosed in Japanese Patent Application Laid-Open Publication No. 61946/1988.

Such a color display device may be typically constructed in such a manner as shown in FIG. 12, wherein a first substrate 110 is made of glass, on which an array of conductive cathode electrodes 112 are arranged. The cathode electrodes 112 each have emitters 114 which are made of metal supported thereon. The array of the cathode electrodes 112 is arranged in a manner to intersect an array of grid electrodes 116 each formed with holes.

The emitters positioned at intersections between the array of the grid electrodes 116 and that of the cathode electrodes 112 each are upwardly directed at a distal end thereof. Also, each of the cathode electrodes 112 and each of the grid electrodes 116 are spaced from each other by means of each of insulating layers 113 interposed therebetween. The insulating layers 113 each are formed with an opening through which electrons are discharged.

A second substrate 122 made of glass is arranged opposite to the first substrate 110. The second substrate 122 is formed thereon with an anode electrode 120, on which phosphors 124 of red, green and blue luminous colors are arranged in parallel with each other.

For selective luminescence of any desired one of the phosphors 124 of red, green and blue luminous colors, the anode electrode 120 is divided into three sections in correspondence to red, green and blue luminous colors as shown in FIG. 13. More particularly, a first anode electrode section having a lead-out wire or electrode 132 connected thereto is provided thereon with a phosphor 124 of a red luminous color, a second anode electrode section having a lead-out wire of electrode 134 connected thereto is provided thereon with a phosphor 124 of a green luminous color, and a third anode section having a lead-out wire or electrode 136 connected thereto is provided thereon with a phosphor 124 of a blue luminous color.

Display of an image of, for example, a red luminous color by the color display device is carried out by selecting, for example, the lead-out electrode 132 of the first anode electrode section to selectively drive the cathode electrode 112 opposite to the first anode electrode section and feeding the gate electrodes 116 with data on a red (R) luminous color while applying an anode electrode to the lead-out electrode 132. This results in the display device carrying out image display of a red luminous color.

Then, an anode voltage is applied to the lead-out electrode 134, during which the cathode electrode 112 next to the cathode electrode 112 described above is selectively driven and data on a green (G) luminous color are fed to the gate electrodes 116, resulting in an image of a green luminous color being displayed.

Subsequently, anode voltage is applied to the lead-out electrode 136, during which the cathode electrode 112 further next to the above-described cathode electrode is selectively driven and data on a blue (B) luminous color are fed to the gate electrodes 116, resulting in an image of a blue luminous color being displayed.

Thus, the display device accomplishes full-color image display.

Such dividing of the anode electrode into three sections requires to draw the three anode lead-out electrodes 132, 134 and 136 from the second substrate 122 because the anode electrode is formed on the second substrate 122 as shown in FIG. 13. However, drawing of the three anode lead-out electrodes 132, 134 and 136 out of the second substrate 122 causes the electrodes to overlap each other as shown in FIG. 13, so that it is required to three-dimensionally arrange the electrodes to separate them from each other. Also, the dividing causes duty of the anode to be one third, to thereby fail to provide the display with increased luminance.

In order to avoid the problem, it would be considered that both cathode and lead-out electrodes are scanned while arranging a single anode lead-out electrode and then the phosphors of R, G and B luminous colors are selectively driven, resulting in the display device displaying a color image.

Unfortunately, such construction causes electrons emitted form the cathode electrodes to impinge on the intended anode electrode section, as well as additional anode electrode sections adjacent thereto, because electrons emitted from the cathode electrode travel toward the anode electrode while spreading to a degree, as will be noted from the fact that in a fluorescent display device, electrons emitted from a cathode are said to travel toward an anode electrode while spreading or diffusing at an angle of about 30 degrees. This leads to luminescence of the additional anode electrode sections as well as the intended anode electrode sections, so that color bleeding occurs in an image displayed.

SUMMARY OF THE INVENTION

The present invention has been made in view of the foregoing disadvantage of the prior art.

Accordingly, it is an object of the present invention to provide a drive circuit for a full-color image display device which is capable of eliminating a necessity of three-dimensionally arranging anode lead-out wires or electrodes.

It is another object of the present invention to provide a full-color image display device which is capable of providing a displayed image with increased luminance while preventing color bleeding.

In accordance with the present invention, a drive circuit for an image display device is provided. In the image display device of the present invention, the image display device includes a first substrate, a plurality of cathode electrodes formed on the first substrate in a stripe-like manner and including emitters for field-emitting electrons, cathode lead-out electrodes led out of the cathode electrodes, respectively, a plurality of stripe-like gate electrodes laminatedly formed on the cathode electrodes in a manner to be perpendicular to the cathode electrodes while being insulated from the cathode electrodes, gate lead-out electrodes led out of the gate electrodes, respectively, a second substrate arranged so as to be spaced at a predetermined distance from the first substrate, a plurality of stripe-like anode electrodes arranged in parallel to the gate electrodes and opposite to the gate electrode in positional relationship of 1:1, phosphors arranged on the anode electrodes in turn to display a color image, and a first anode lead-out electrode connected to the anode electrodes at every second interval and a second anode lead-out electrode connected to the remaining part of the anode electrodes. The first and second anode lead-out electrodes are alternately driven. Only a part of the gate electrodes arranged opposite to the anode electrodes driven are driven. A part of the gate electrodes adjacent to the gate electrodes driven is kept at a low level.

In a preferred embodiment of the present invention, the image display device further includes at least one dummy electrode arranged on each of both sides of the gate electrodes for preventing leakage luminescence.

In a preferred embodiment of the present invention, the image display device further includes at least one dummy electrode arranged on each of both sides of the anode electrodes for preventing leakage luminescence.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein:

FIGS. 8(*a*) to 8(*d*) each are a schematic view showing selection of picture cells carried out by a drive circuit for an image display device according to the present invention;

FIG. 11(*b*) is a sectional view of the conventional field emission cathode shown in FIG. 11(*a*);

DETAILED DESCRIPTION OF THE PREFERRED EMBODIMENTS

Now, a drive circuit for an image display device according to the present invention will be described hereinafter with reference to embodiments thereof shown in FIGS. 1 to 10. The following embodiments each are directed to a drive circuit for an image display device constructed so as to exhibit red, blue and green luminous colors by luminescence of phosphors per se without using any filter.

Figure 1:
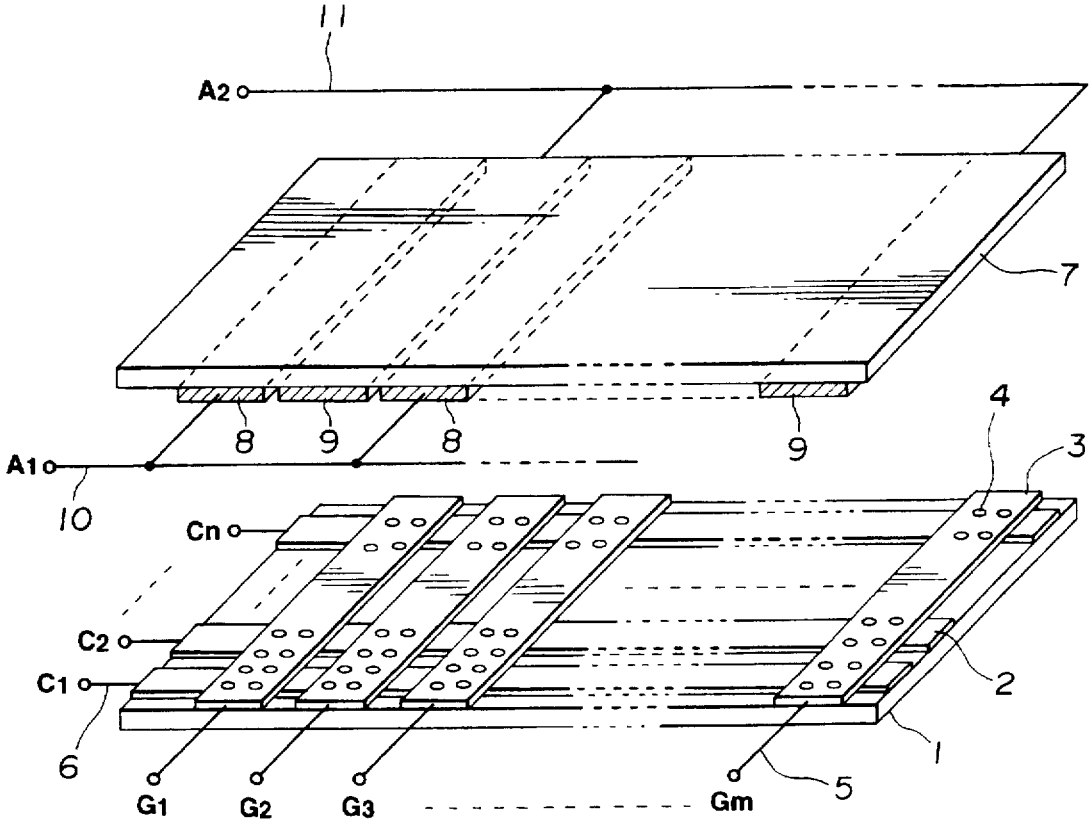
FIG. 1 is a perspective view showing an example of an image display device driven by a drive circuit according to the present invention.

Referring first to FIG. 1, an image display device to which a drive circuit according to the present invention is applied is illustrated by way of example. In FIG. 1, reference numeral 1 designates a cathode substrate which is made of glass or the like and provided thereon with an FEC array, 2 is a plurality of stripe-like cathode electrodes formed on the cathode substrate 1, 3 is a plurality of stripe-like gate electrodes arranged on the cathode electrodes 2 through in insulating layer (not shown) in a manner to extend in a direction perpendicular to the cathode electrodes 2, and 4 is electron emission holes formed at each of the gate electrodes 3, through which electrons are discharged.

Reference numeral 5 designated gate lead-out electrodes (G1 to Gm) led out of the stripe-like gate electrodes 3, respectively, 6 is cathode lead-out electrodes (C1 to Cn) led out of the stripe-like cathode electrodes 2, respectively, 7 is a first or anode substrate arranged so as to be opposite to the first or cathode substrate 1, 8 is first stripe-like anode electrodes formed on the anode substrate 7, 9 is second stripe-like anode electrodes each arranged between each adjacent two of the first stripe-like anode electrodes 8, 10 is a first anode lead-out electrode A1 led out of the first stripe-like anode electrodes 8 in common, and 11 is a second anode lead-out electrode A2 led out of the second stripe-like anode electrodes 9 in common.

The first stripe-like anode electrodes 8 have R, G and B phosphors deposited thereon, respectively. Likewise, the second stripe-like anode electrodes 9 have R, G and B phosphors deposited thereon, respectively. Now, the manner of driving of the conventional image display device of FIG. 1 thus constructed will be briefly described by way of example, although detailed description of the driving will be made hereinafter. The anode electrodes 8 and 9 are driven while being selected by the first and second anode lead-out electrodes A1 and A2, respectively.

Also, the cathode lead-out electrodes C1 to Cn of the stripe-like cathode electrodes 2 are scanned, resulting in the cathode electrodes 2 being selected and driven in order.

More particularly, the cathode lead-out electrodes C1 to Cn are scanned in order while keeping a positive anode voltage applied to the first anode lead-out electrode A1 for selectively driving the anode electrodes 8. During the scanning, image data on a picture cell for display depending on timings of scanning of the cathode lead-out electrodes are fed to the gate lead-out electrodes G1 to Gm.

Thus, picture cells defined by the phosphors arranged on the anode electrodes 8 are excited by electrons emitted from emitters provided on the cathode electrodes 2 scanned and luminescence of the picture cells is controlled depending on image data fed to the gate lead-out electrodes G1 to Gm.

When successive scanning of the cathode lead-out electrodes C1 to Cn is completed, a positive anode voltage is then applied to the second anode lead-out electrodes A2 in place of the first ones A1.

During such application, the cathode lead-out electrodes C1 to Cn are likewise scanned in order. It is a matter of course that at this time, image data on picture cells for display depending on timings of scanning of the cathode lead-out electrodes are likewise fed to the gate lead-out electrodes G1 to Gm. This permits picture cells defined by the phosphors provided on the anode electrodes 9 to be excited for luminescence by electrons emitted from the emitters arranged on the cathode electrodes 2 connected to the cathode lead-out electrodes C1 to Cn thus scanned. Luminescence of the picture cells is controlled depending on the image data fed to the gate electrodes 3, resulting in an image for one image plane (frame) being displayed.

Figure 2:
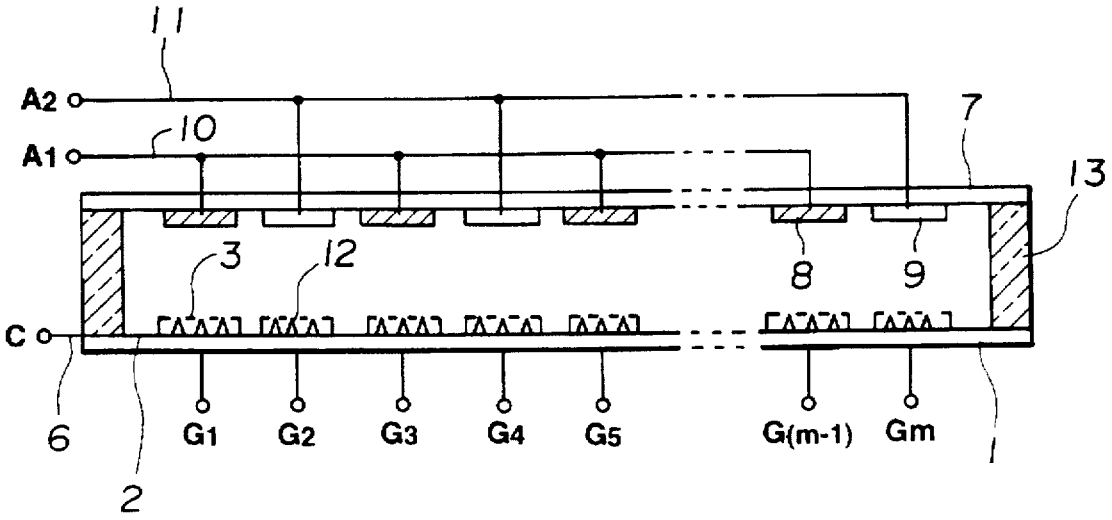
FIG. 2 is a sectional view of the image display device shown in FIG. 1.

The image display device will be described more detailedly with reference to FIG. 2. In FIG. 2, reference numeral 12 designates an emitter array including emitters of a conical shape formed on the cathode electrodes 2 by fine processing techniques for a semiconductor so as to field-emit electrons therefrom and 13 is spacers arranged between the cathode substrate 1 and the anode substrate 7 to space the substrates from each other while supporting them thereon. Thus, the cathode substrate 1, anode substrate 7 and spacers 13 cooperated with each other to provide an envelope, which is then evacuated to a high vacuum.

Figure 3:
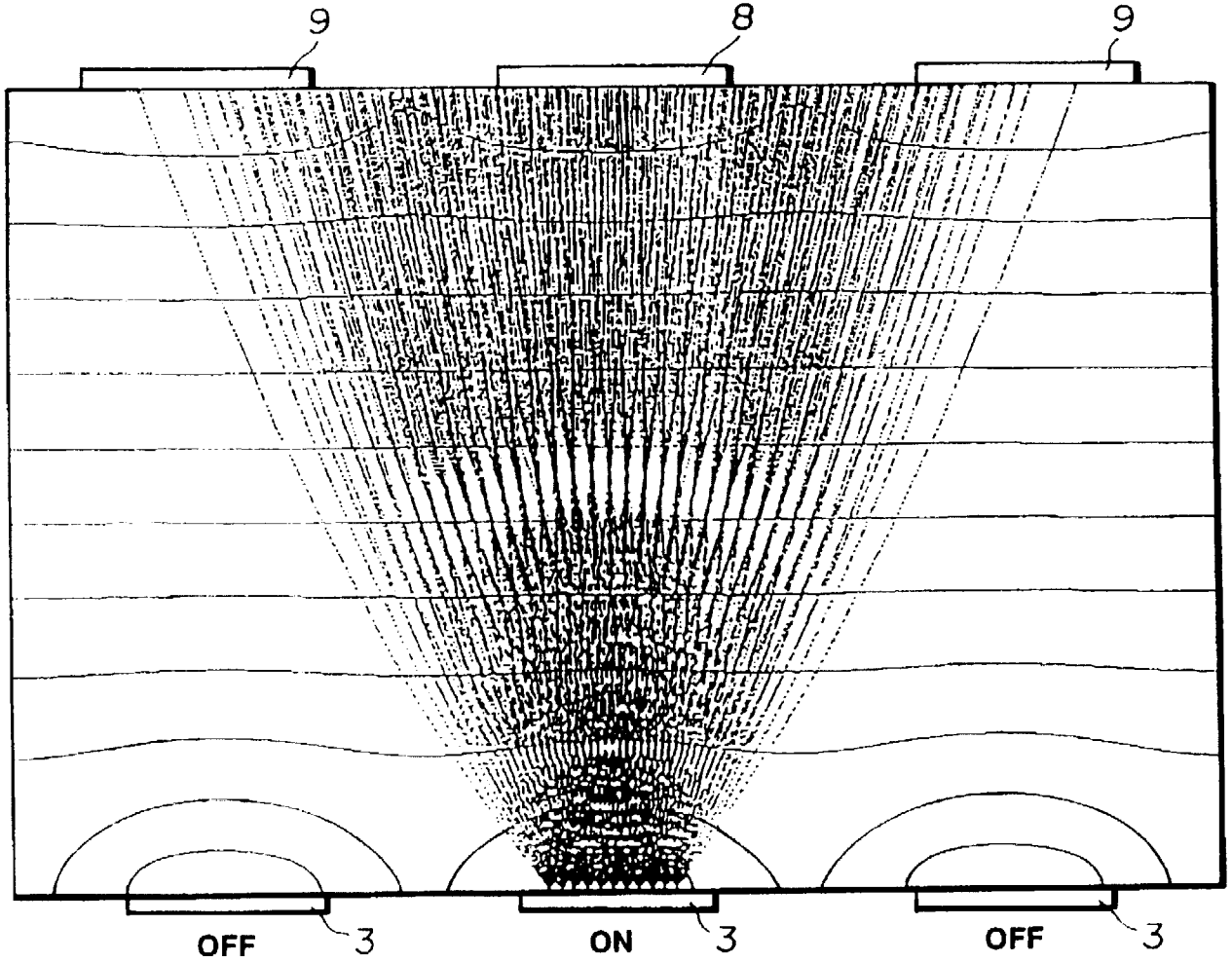
FIG. 3 is a diagrammatic view showing a locus of electrons emitted from a cathode electrode and a distribution of the electrons.

The image display device shown in FIG. 2 is so constructed that the stripe-like gate electrodes 3 are arranged in relationship of 1:1 to each of the first and second anode electrodes 8 and 9. Results of simulation of a locus of electrons emitted from the emitter array 12 and a distribution thereof in the image display device of FIG. 2 are shown in FIG. 3 by way of example. It is generally said that field-emission of electrons from an emitter array is carried out while spreading or diffusing at an angle of about 30 degrees. Thus, in the image display device of FIG. 2, electrons field-emitted from the emitter array 12 are caused to travel to the anode electrodes 28 while considerably spreading from an end of the gate electrodes 3. In this instance, the anode electrodes 8 and 9 are kept at the same potential and the gate electrodes 3 are maintained at the same potential irrespective of turning-on and turning-off thereof.

Figure 4:
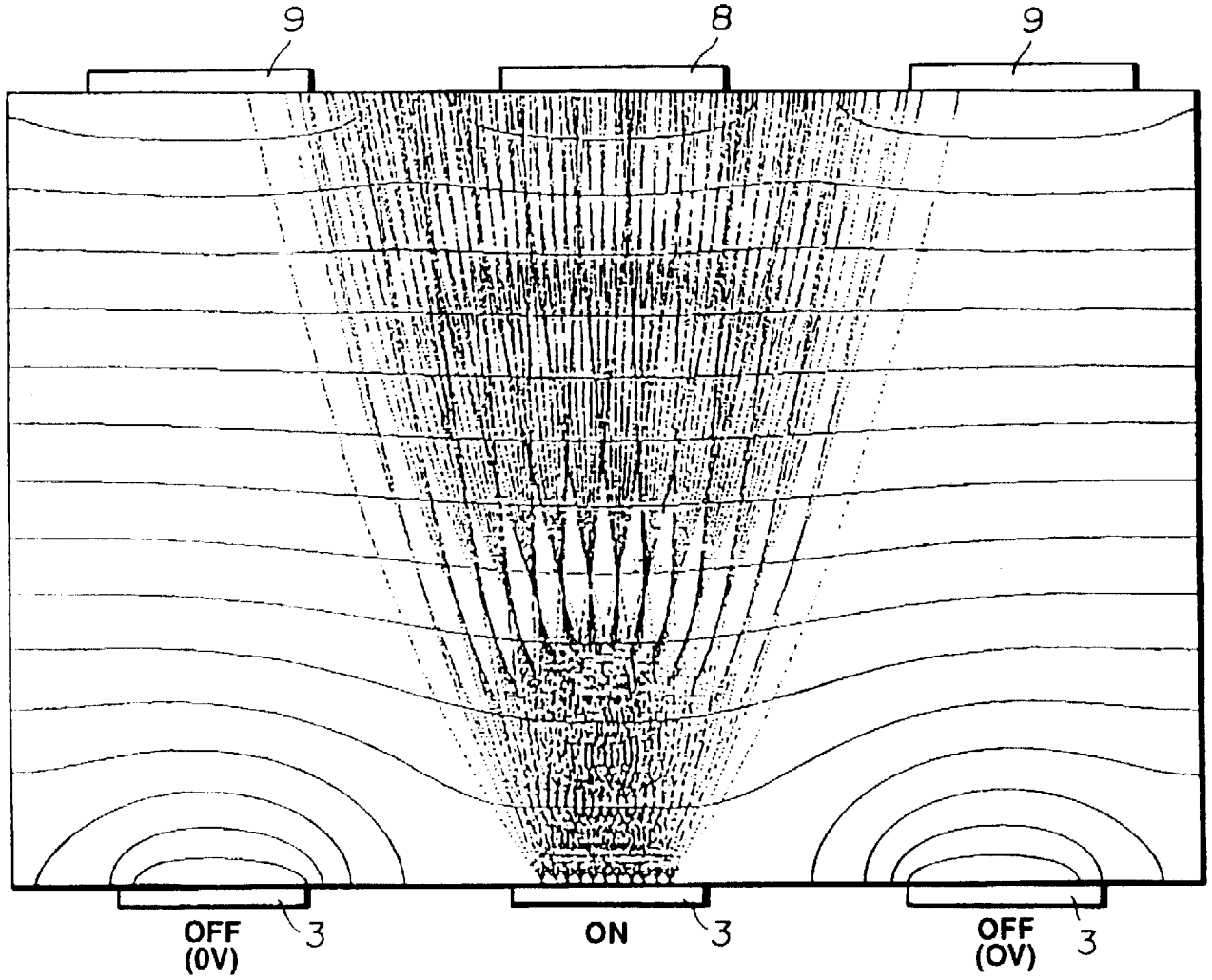
FIG. 4 is a diagrammatic view showing a locus of electrons emitted from a cathode electrode and a distribution of the electrons.

Then, results of simulation of a locus of electrons emitted from the emitter array 12 and a distribution thereof when a potential of the gate electrodes 3 turned off is set at a ground level while keeping both anode electrodes 8 and 9 set at the same potential are shown in FIG. 4 by way of example. In this instance, spreading of the electrons is somewhat reduced.

Figure 5:
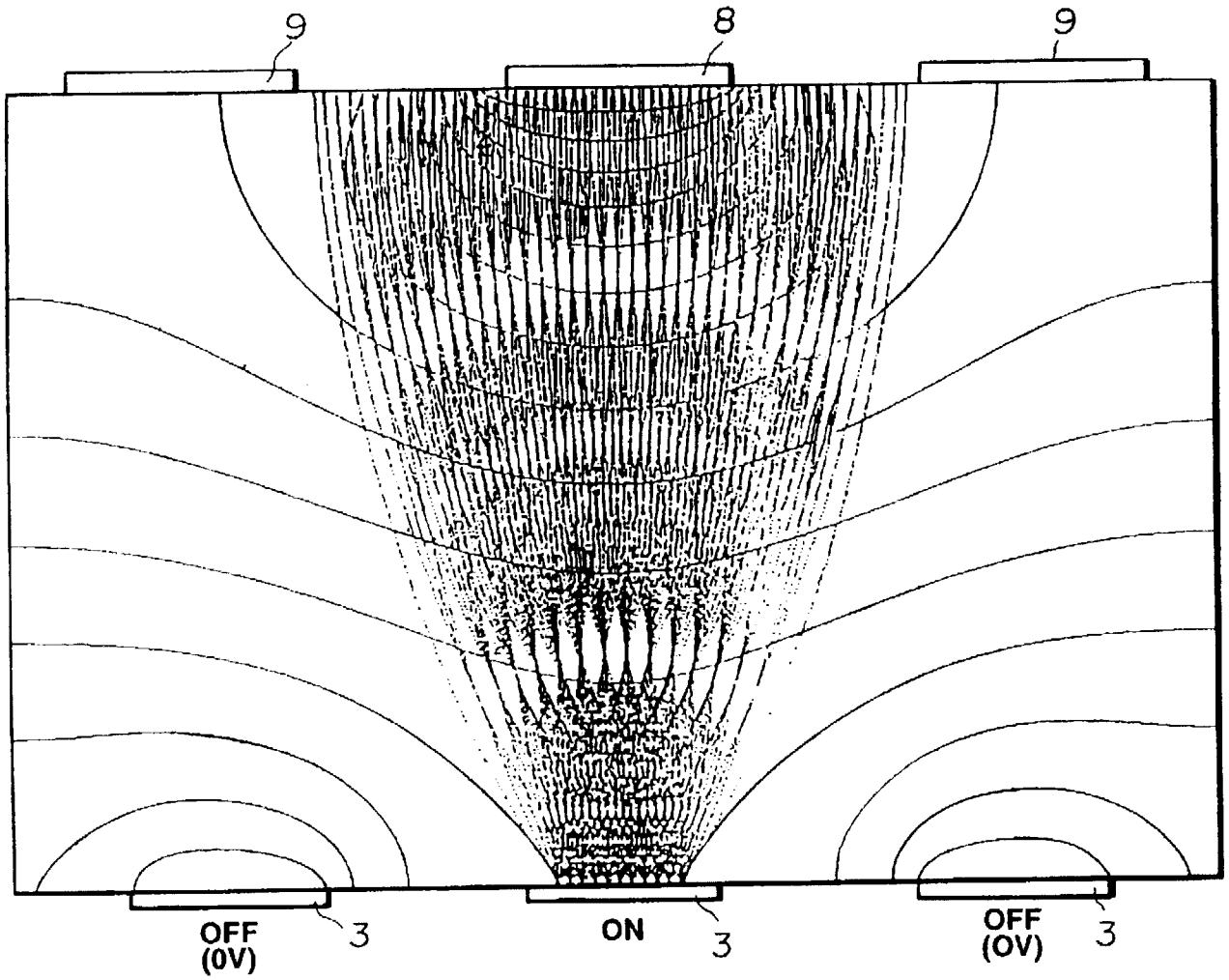
FIG. 5 is a diagrammatic view showing a locus of electrons emitted from a cathode electrode and a distribution of the electrons.

Also, results of simulation of a locus of electrons emitted from the emitter array 12 and a distribution thereof when a potential of the gate electrodes 3 turned off is set at a ground level while setting a potential of the anode electrodes 9 turned off at a level about one half as high as a level of a potential of the anode electrodes 8 turned on are shown in FIG. 5 by way of example. In this instance, spreading of the electrons is considerably reduced.

Figure 6:
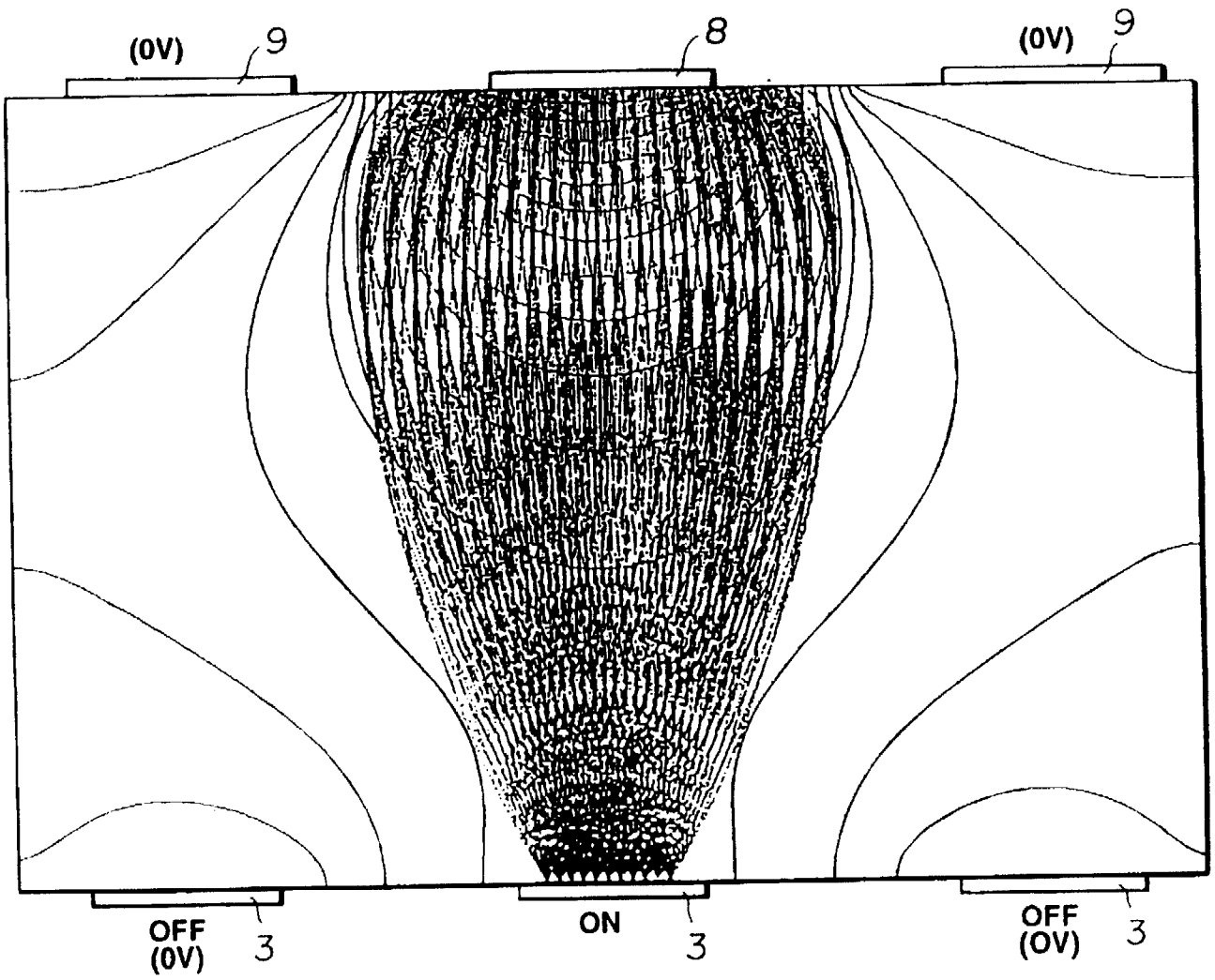
FIG. 6 is a diagrammatic view showing a locus of electrons emitted from a cathode electrode and a distribution of the electrons.

Further, results of simulation of a locus of electrons emitted from the emitter array 12 and a distribution thereof when a potential of the gate electrodes 3 turned off is set at a ground level while keeping a potential of the anode electrodes 9 which are turned off set at a ground level are shown in FIG. 6 by way of example. In this instance, spreading of the electrons is highly reduced, resulting in the electrons being substantially directed to only the anode electrodes 8 intended.

FIGS. 3 to 6 clearly indicate that driving of the anode electrodes 8 and 9 and gate electrodes 3 in a manner to permit the results shown in FIGS. 5 and 6 to be obtained leads to luminescence of only the phosphors deposited on the anodes 9 intended, to thereby effectively present leakage luminescence due to spreading of electrons. The drive circuit of the present invention is adapted to significantly reduce spreading of electrons in such a manner as shown in FIGS. 5 or 6. Now, the drive circuit of the present invention will be described hereinafter.

Figure 7:
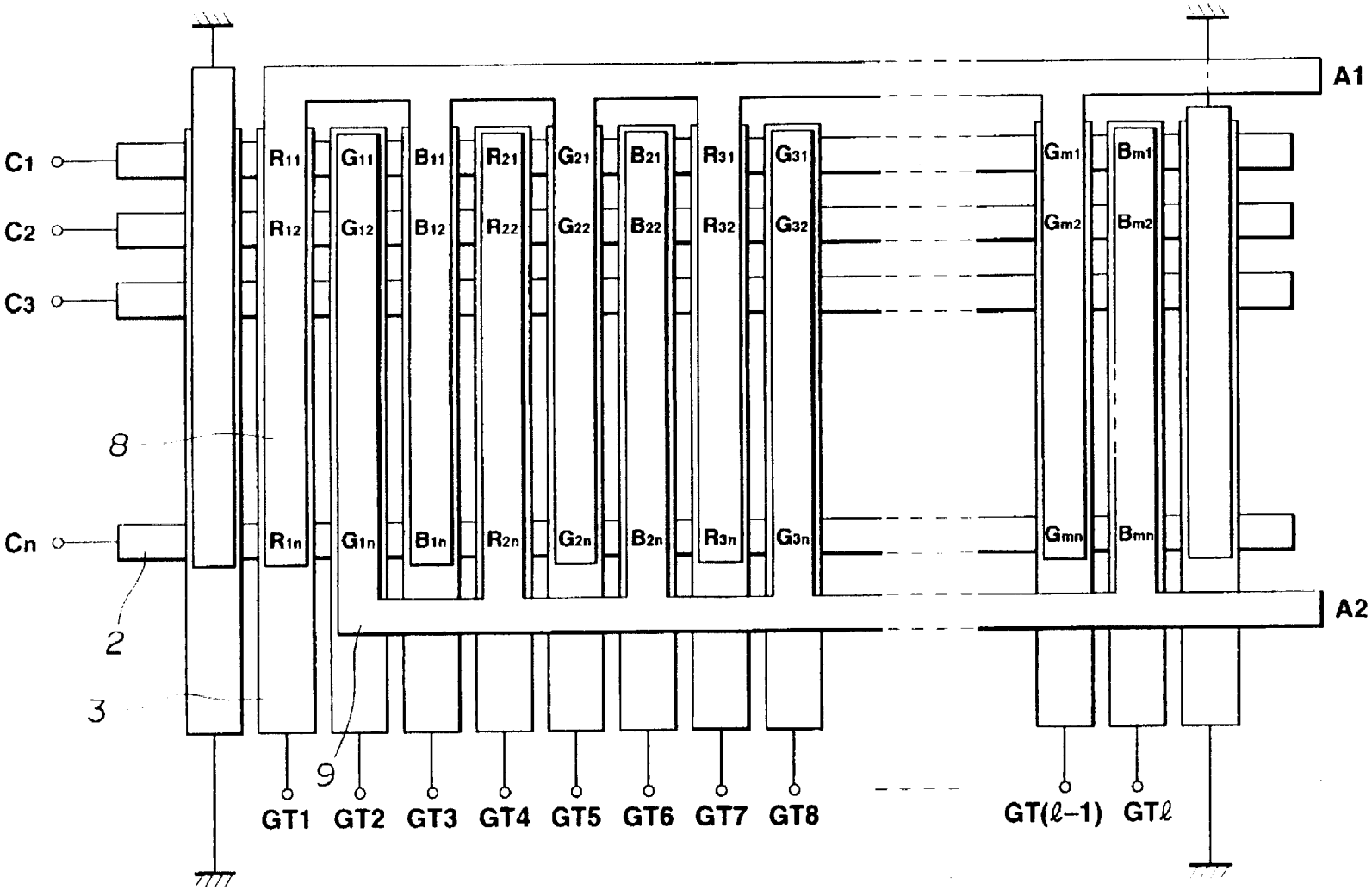
FIG. 7 is a schematic view showing an example of arrangement of electrodes incorporated in an image display device driven by a drive circuit according to the present invention.

Referring now to FIG. 7, respective electrodes of an image display device driven by the drive circuit of the present invention which are viewed from a side of anode electrodes are shown. A first anode lead-out electrodes A1 is led out of first anode electrodes 8 on one side and a second anode lead-out electrode A2 is led out of second anode electrodes 9 on the other side. Stripe-like gate electrodes 3 are arranged in parallel to the anode electrodes 8 and 9 in a manner to be spaced from and opposite to the anode electrodes 8 and 9. The gate electrodes 3 have gate lead-out electrodes GT1, GT2, . . . GT(1-1), GT1 led out thereof, respectively.

Stripe-like cathode electrodes 2 are arranged below the gate electrodes 3 in a manner to be perpendicular to the first and second anode electrodes 8 and 9 and cathode lead-out electrodes C1, C2, . . . Cn are led out of the stripe-like cathode electrodes 2, respectively. The cathode electrodes 2 are formed thereon with emitter arrays for emitting electrons therefrom.

The first and second stripe-like anode electrodes 8 and 9 have phosphors of red, green and blue luminous colors deposited thereon in predetermined order or in order in a direction of a left-hand side to a right-hand side in FIG. 7, respectively. This results in picture cells being defined at positions at which the anode electrodes 8 and 9 intersect the cathode electrodes 2, wherein a first picture cell line is constituted by picture cells R11, G11, B11; R21, G21, G21; . . . ; Rm1, Gm1, Bm1. Then a second picture cell line is defined by picture cells R12, G12, B12; . . . ; Rm2, Gm2, Bm2. Likewise, a last picture cell line is defined by picture cells R1n, G1n, B1n; . . . ; Bmn, Gmn, Bmn.

The picture cells R11 to Bmn thus defined are arranged in a matrix-like manner and selectively driven by the anode lead-out electrodes A1 and A2 and cathode lead-out electrodes C1 to Cn. The gate electrodes 3 are provided on each of both sides thereof with a dummy gate for converging electrons and likewise the anode electrodes 8 and 9 are provided on each of both sides thereof with a dummy anode.

Now, driving of the picture cells defined by the electrodes arranged as shown in FIG. 7 will be described with reference to FIGS. 8(*a*) to 8(*d*), where R, B and G indicate the picture cells shown in FIG. 7, from which suffixes are deleted for the sake of brevity.

FIG. 8(*a*) shows a state that the cathode lead-out electrode C1 is selected while applying a positive anode electrode to the anode lead-out electrode A1, resulting in picture cells thus selected being ready for luminescence or permitted to emit light.

More particularly, this results in the picture cells R, B and G of the first picture cell line which are deposited on the stripe-like anode electrodes corresponding to the anode lead-out electrode A1 and have oblique lines drawn thereon in FIG. 8(*a*) being permitted to emit light. The luminescence permitted picture cells are arranged at every second interval because the anode lead-out electrode A1 is led out at every second interval from the anode electrodes. Then, luminescence of the picture cells is controlled by R, B and G image date concurrently applied to the gate lead-out electrodes GT1 to GT1 of the gate electrodes 3.

FIG. 8(*b*) shows a timing state next to that of FIG. 8(*a*) described above, wherein the cathode lead-out electrode C2 is selected while keeping a positive anode voltage still applied to the anode lead-out electrode A1, resulting in picture cells thus selected being permitted to emit light.

Figure 9:
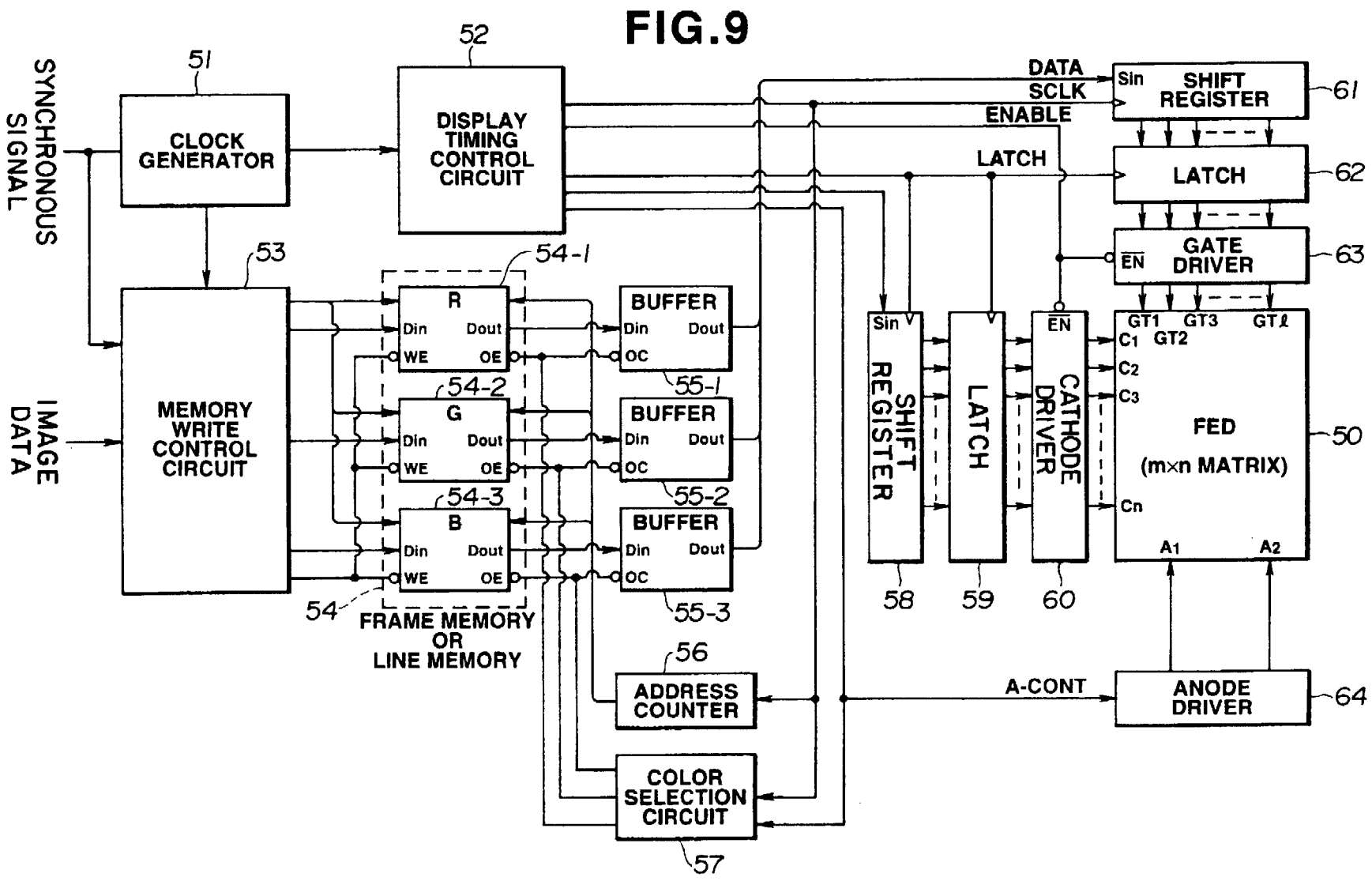
FIG. 9 is a block diagram showing a drive circuit for an image display device according to the present invention.

More particularly, this results in the picture cells R, B and G of the second picture cell line which have oblique lines drawn thereon in FIG. 9(*b*) being permitted to emit light. In this instance, the luminescence permitted picture cells are likewise arranged at every second interval. Then, luminescence of the picture cells is controlled by R, B and G image date concurrently applied to the gate lead-out electrodes GT1 to GTn of the gate electrodes 3.

Driving in such a manner is repeatedly carried out in order; so that when scanning is carried out on the last cathode lead-out electrode Cn, such a state as shown in FIG. 8(*c*) may be obtained. In this instance, the cathode lead-out electrode C1 is selected while keeping a positive anode voltage applied to the anode lead-out electrode A2, resulting in picture cells thus selected being permitted to emit light.

More specifically, this results in the picture cells R, B and G of the first picture cell line which correspond to the anode lead-out electrode A2 and have oblique lines drawn thereon in FIG. 8(*c*) being permitted to emit light. The picture cells of which luminescence is thus permitted are likewise arranged at every second interval. Then, luminescence of the picture cells is controlled by R, B and G image date concurrently applied to the gate lead-out electrodes GT1 to GTn of the gate electrodes 3.

At this time, all the picture cells of the first picture cell line are subject to luminous control. Then, driving of the picture cells in shifted to a state shown in FIG. 8(*d*), wherein the cathode lead-out electrode C2 is selected in place of the cathode lead-out electrode C1 while keeping a positive anode voltage applied to the anode lead-out electrode A2 of the anode electrodes 9, resulting in picture cells thus selected being ready for luminescence.

This results in the picture cells of the second picture cell lien being ready for luminescence. The picture cells are subject to luminous control depending on G, R and B image data concurrently applied to the gate lead-out electrodes GT1 to GTn.

Thus, the cathode lead-out electrodes C1 to Cn are scanned in order while keeping a positive anode voltage to the anode lead-out electrode A2, so that when scanning of the last cathode lead-out electrode Cn is effected, all the picture cells in the display device may be ready for luminescence and subject to luminous control, leading to display of an image for one frame on the display device.

Figures 10A, 10B, 10C, 10D, 10E, 10F:
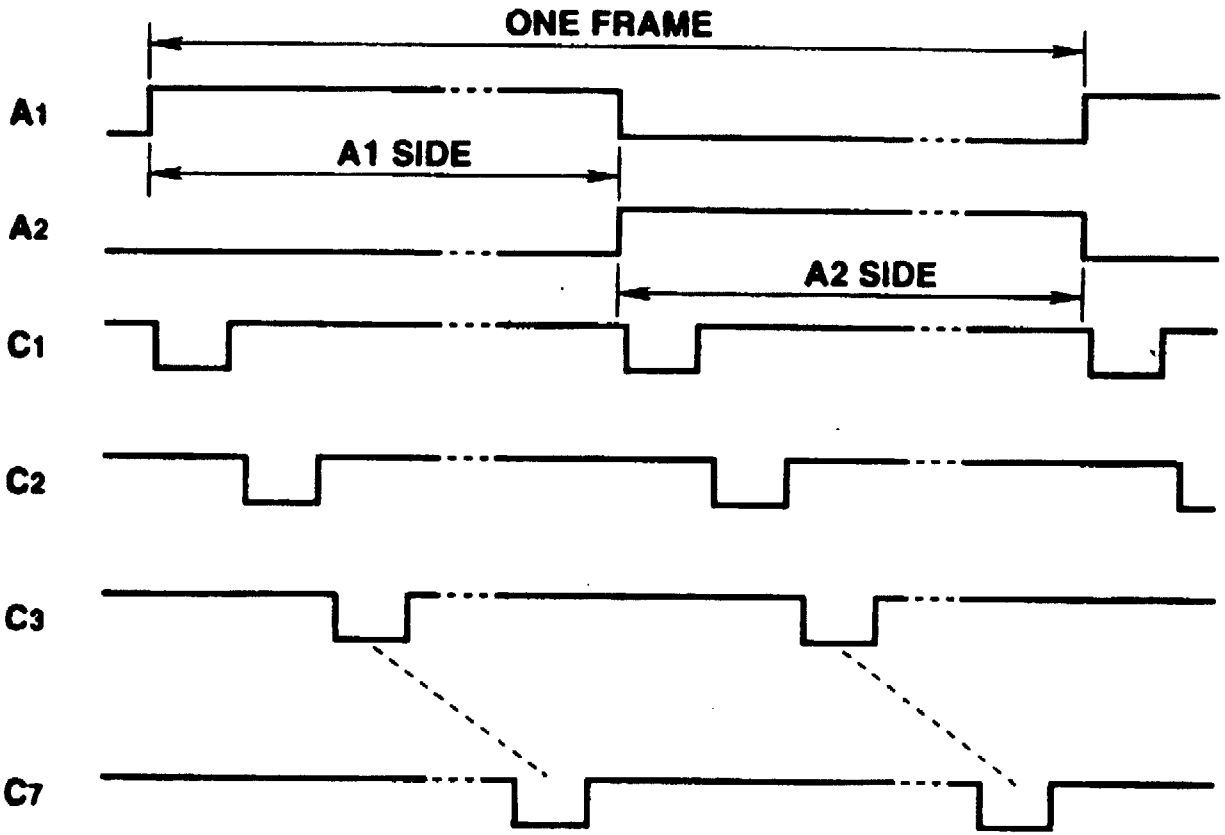
FIG. 10 is a group of timing charts each showing operation of a drive circuit for an image display device according to the present invention.
Figures 10G, 10H, 10I, 10J, 10K, 10M, 10N, 10P:
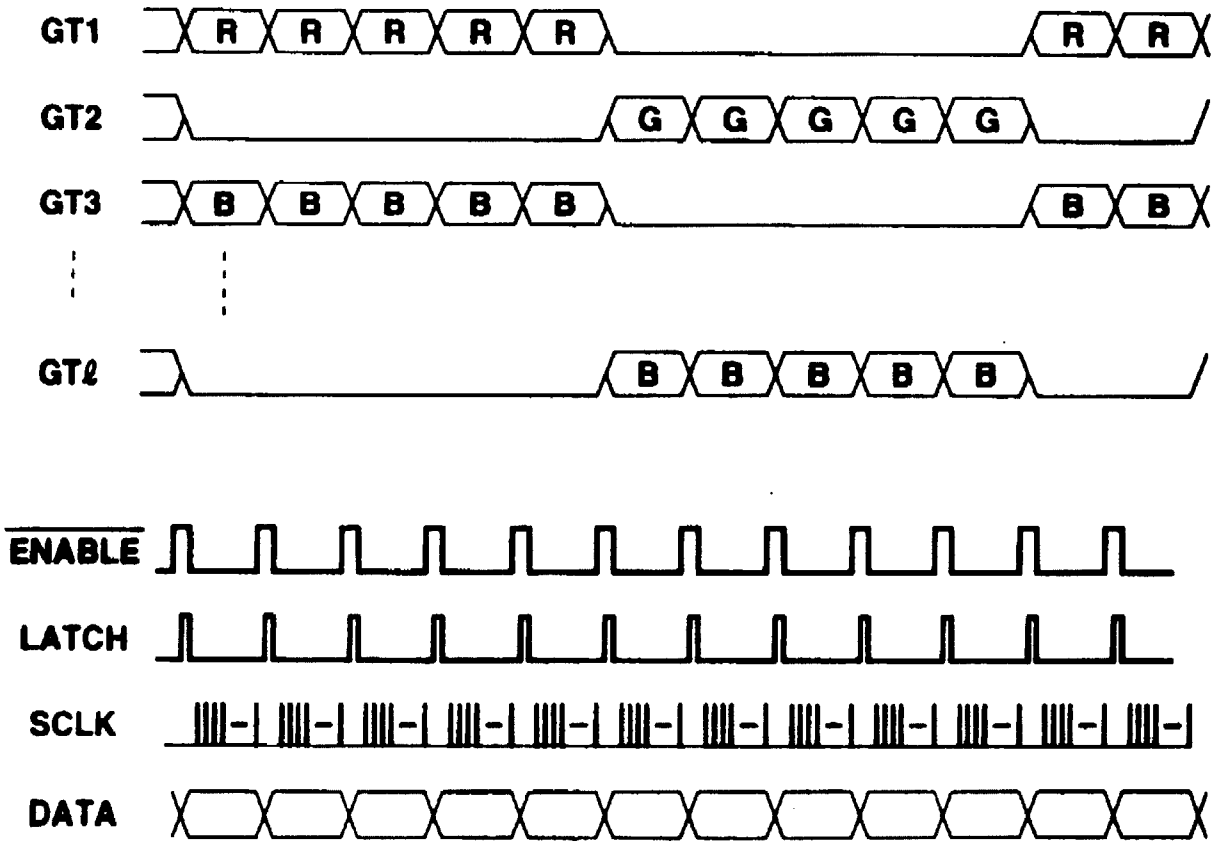
Figure 11A:
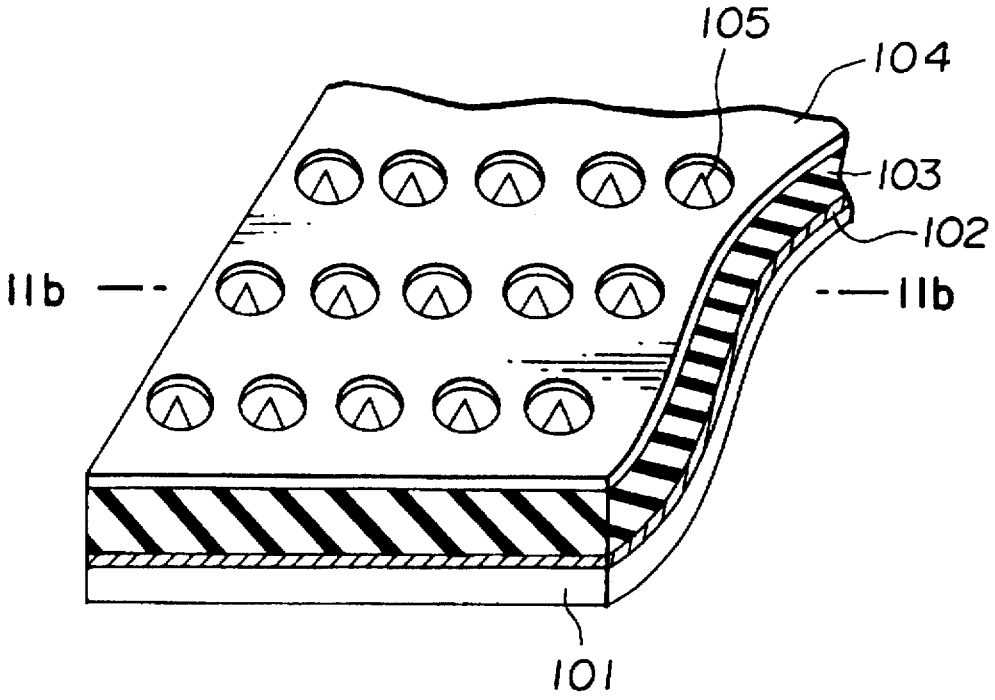
FIG.11(a) (PRIOR ART)
FIG. 11(*a*) is a perspective view showing a conventional field emission cathode.
Figure 11B:
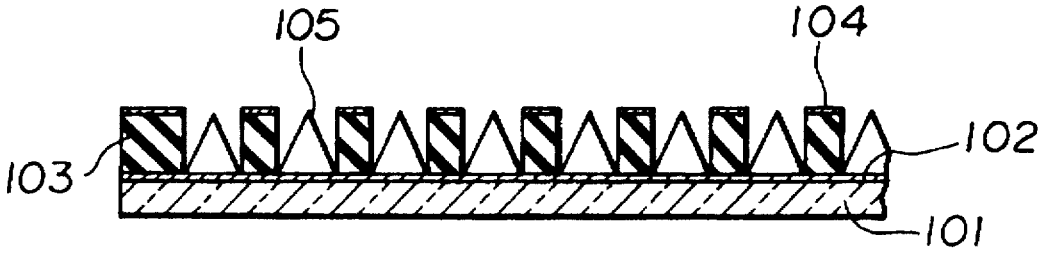
FIG.11(b) (PRIOR ART)
Figure 12:
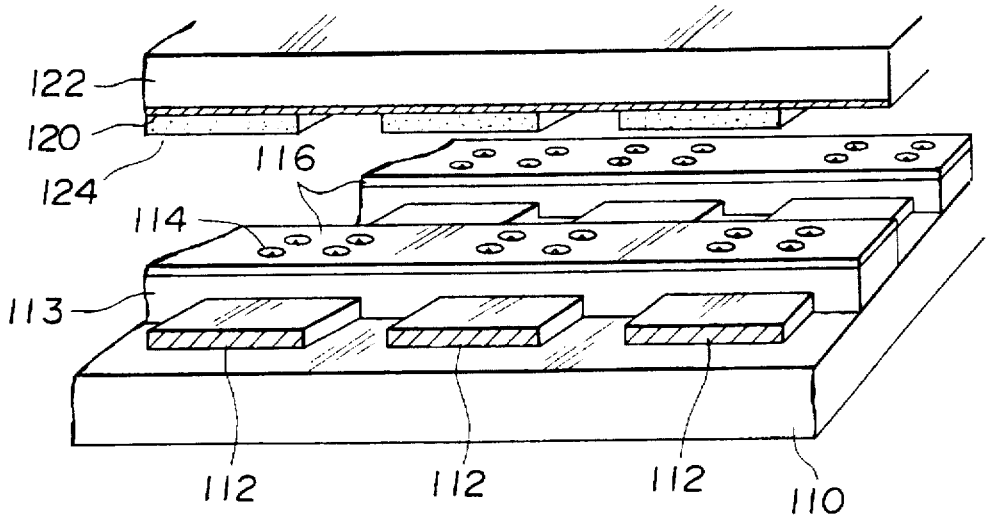
FIG. 12 is a fragmentary perspective view in section showing a conventional image display device.
Figure 13:
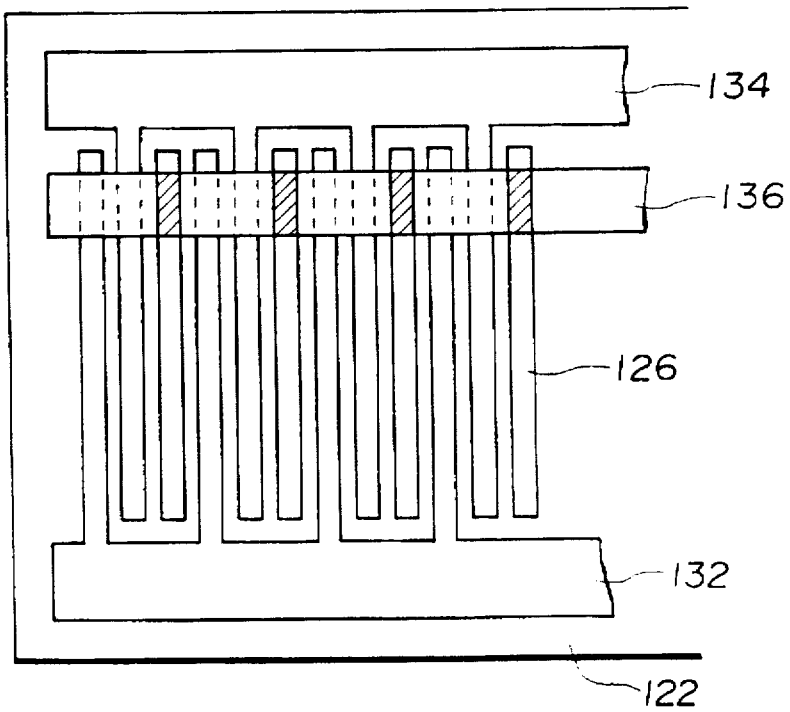
FIG. 13 is a schematic view showing arrangement of an anode electrode and anode lead-out electrodes in a conventional image display device.

A drive unit for practicing such driving and control as described above is shown in FIG. 9 and timings of operation of the drive unit are shown in FIG. 10.

In FIG. 9, reference numeral 50 designates an image display device in which a field emission cathode including m×n picture cells arranged in a matrix-like manner in incorporated, 52 is a clock generator for generating a clock in synchronism with a synchronous signal applied thereto, 52 is a display timing control circuit for controlling a display timing by means of a clock generated from the clock generator, and 53 is a memory write control circuit for controlling writing of a video memory 54. The video memory 54 includes frame memories or line memories 54-1, 54-2 and 54-3 for storing R, G and B image data therein, respectively. 55-1, 55-2 and 55-3 designate buffer registers for holding therein R, G and B image data read out of the video memory 54, respectively.

Reference numeral 56 is an address counter for generating an address of the video memory 54, 57 is a color selection circuit for selecting color data, 58 is a shift register for shifting data for controlling the cathode electrodes, 59 is a latch circuit for latching data of the shift register 58, 60 is a cathode driver for driving the cathode electrodes by means of data of the latch circuit 59, 61 is a shift register for shifting image data fed from the buffer registers 55-1 to 55-3 by means of a shift clock, 62 is a latch circuit for latching data of the shift register 61, and 63 is a gate driver for driving the gate electrodes by means of an output of the latch circuit 62.

(a) of FIG. 10 indicates an output pulse of an anode driver 64 for driving the anode lead-out electrode A1, (b) of FIG. 10 is an output pulse of the anode driver 64 for driving the anode lead-out electrode A2, (c) of FIG. 10 is an output pulse of the cathode driver 60 for driving the cathode lead-out electrode C1, (d) of FIG. 10 is an output pulse of the cathode driver 60 for driving the cathode lead-out electrode C2, (e) of FIG. 10 is an output pulse of the cathode driver 60 for driving the cathode lead-out electrode C3, and (f) of FIG. 10 is an output pulse of the cathode driver for driving the cathode lead-out electrode Cn.

Also, (g) of FIG. 10 indicates color data fed from the gate driver 63 to the gate lead-out electrode GT1, (h) of FIG. 10 is color data fed from the gate driver 63 to the gate lead-out electrode GT2, (i) of FIG. 10 is color data fed from the gate driver 63 to the gate lead-out electrode GT3, (j) of FIG. 10 is color data fed from the gate driver 63 to the gate lead-out electrode GT1, (k) of FIG. 10 is an enable signal for controlling operation of the cathode driver 60, (n) of FIG. 10 is a shift clock fed to the shift register 61, and (p) of FIG. 10 is image data fed from the gate driver 63 to the gate lead-out electrodes GT1 to GTn of the gate electrode 3.

Now, the manner of operation of the drive unit of the image display device 50 will be described hereinafter with reference to FIG. 10.

Image data are subject to write timing control by the memory write control circuit 53 and stored for every color in the video memory 54 in synchronism with a clock generated from the clock generator 51. Color data which are read out, depending on an address of the address counter 56, from the memories 54-1, 54-2 and 54-3 of the video memory 54 having the R, G, and B image data stored therein while being controlled by the color selection circuit 57 are held in the buffer registers 55-1, 55-2 and 55-3, respectively.

The buffer registers 55-1, 55-2 and 55-3 are subject to output timing control by the color selection circuit 57, so that the image data are arranged in the same order as display by the picture cells of R, G and B luminous colors shown in FIG. 8 and then fed to the shift register 61. The shift register 61 act to shift the image data by means of a shift clock SCLK shown in (n) of FIG. 10.

When, of the image data for the picture cells of one picture cell line, the image data in number one half as many as the number of stripe-like anode electrodes connected to the anode lead-out electrodes are shifted at every second interval to the shift register 61, the image data are then latched in the latch circuit 62 by means of a latch pulse shown in (m) of FIG. 10. Data output from the latch circuit 62 are fed to the gate driver 63.

The display control timing circuit 52 acts to control the anode driver 64 to apply a positive anode voltage to only the anode lead-out electrode A1 as shown in (a) and (b) of FIG. 10. Also, the display timing control circuit 52 feeds the shift register with the above-described latch pulse shown in (m) of FIG. 10 in the form of a shift pulse, resulting in a scan signal fed from the control circuit 52 being shifted. An output of the shift register 58 is latched in the latch circuit 59 by means of the latch pulse described above, so that the latch circuit 59 outputs a scan signal shifted for every latch pulse. The scan signal is then fed to the cathode driver 60.

This results in a cathode drive voltage being applied from the cathode driver 60 to the cathode lead-out electrodes C1, C2, C3, . . . Cn of the image display device 50 in order as shown in (c), (d), (e) and (f) of FIG. 10, so that the cathode lead-out electrodes C1, C2, C3, . . . Cn each may be scanned at a timing of the latch pulse.

At this time, the image data shown in (g), (h), (i) and (j) of FIG. 10 are fed from the gate driver 63 to the gate lead-out electrodes GT1 to GT1 at every second interval for every ½ frame in synchronism with scanning of the cathode lead-out electrodes C1 to Cn. Thus, when an anode voltage is applied to the anode lead-out electrode A1 while the cathode lead-out electrodes C1 is kept driven, the gate lead-out electrodes in odd numbers are fed with R, B, G, . . . image data shown in (a) of FIG. 8.

The gate lead-out electrodes GT2 to GT1 in even numbers which are not fed with the image data are kept at a ground level. This causes half of the picture cells of the first picture cell line in the image display device 50 to be subject to luminous control as shown in FIG. 8(*a*).

Then, when the cathode lead-out electrode C2 is selected at the next timing of the latch pulse, half of the picture cells of the second picture cell line in the image display device 50 are subject to luminous control as shown in FIG. 8(*b*) because the image data for the next second picture cell line are shifted in the shift register 61 by means of the shift clock SCLK.

Such scanning is carried out in order; so that when the last cathode lead-out electrode Cn is scanned, luminous control for half of the picture cells for one frame is accomplished.

Then, the display timing control circuit 52 controls the anode driver 64 to apply a positive anode voltage to the anode lead-out electrode A2. Such application of the anode voltage to the anode lead-out electrode A2 causes the G, R, B, . . . image data shown in FIG. 8(*a*) to be fed to the gate lead-out electrode GT2 to GT1 in even numbers. The gate lead-out electrodes GT2 to GT1 in odd numbers which are not fed with the image data are kept at a ground level.

Scanning of the cathode lead-out electrodes C1 to Cn in substantially the same manner as described above causes the remaining picture cells for one frame to be subject to luminous control as shown in FIGS. 8(*c*) and 8(*d*). Thus, when scanning of the last cathode lead-out electrode Cn is carried out, an image for one frame is permitted to be displayed on the image display device 50.

The drive unit for the image display device permits the number of times of changing-over of the anode lead-out electrodes having a high voltage applied thereto to be reduced to only two, to thereby facilitate fabrication of the drive circuit for the anode lead-out electrodes.

Also, the present invention permits a potential of anode electrodes unselected or unintended which are positioned on both sides of selected or intended anode electrodes in a manner to be adjacent thereto to be reduced to a level of about ½ or below and a potential of the gate electrodes to be set at a ground level, resulting in electrons being converged as shown in FIG. 5 or 6, to thereby prevent color mixing and color bleeding.

The gate driver 63 may drive capacitive load, so that a driver of the totem pole type driver rather than that of the open collector type is suitable for the driver.

Further, in the embodiments described above, the phosphors of red, blue and green luminous colors are used. Alternatively, the embodiments may be so constructed that a phosphor of a wider luminous wavelength range is used and light emitted from the phosphor is permitted to pass through a filter having different wavelength transmission characteristics. Such construction permits a plurality of luminous colors such as red, blue, green and the like to be obtained using only one kind of phosphor. In this instance, two kinds of phosphors different in luminous color may be used for color image display.

As can be seen from the foregoing, the drive circuit of the present invention permits the number of anode lead-out electrodes incorporated in the image display device to be reduced to only two, so that the anode lead-out electrodes may be two-dimensionally led out on both sides of the substrate without using any three-dimensional wiring structure.

Also, such division of the anode electrodes into two in the present invention permits the device to exhibit duty 3/2 times as large as that of the conventional anode electrodes divided into three, to thereby provide an image obtained with increased luminance.

Further, the present invention permits a potential of anode electrodes adjacent to anode electrodes selected for driving to be lowered to a level about one half as high as that of the selected anode electrodes and a potential of gate electrodes adjacent to gate electrodes selected for driving to be set at a ground level, so that electrons emitted may be effectively converged to provide a color image substantially free of any color bleeding.

While a preferred embodiment of the invention has been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A drive circuit for an image display device, wherein said image display device comprises:

a first substrate;

a plurality of cathode electrodes formed on said first substrate in a stripe-like manner and including emitters for field-emitting electrons;

cathode lead-out electrodes led out of said cathode electrodes, respectively;

a plurality stripe-like gate electrodes laminatedly formed on said cathode electrodes in a manner to be perpendicular to said cathode electrodes while being insulated from said cathode electrodes;

gate lead-out electrodes led out of said gate electrodes, respectively;

a second substrate arranged so as to be spaced at a predetermined distance from said first substrate;

a plurality of stripe-like anode electrodes arranged in parallel to said gate electrodes and opposite to said gate electrode in positional relationship of 1:1;

phosphors arranged on said anode electrodes in turn to display a color image; and a first anode lead-out electrode connected to said anode electrodes at every second interval and a second anode lead-out electrode connected to the remaining part of said anode electrodes;

said first and second anode lead-out electrodes being alternately driven;

only a part of said gate electrodes arranged opposite to said anode electrodes driven being driven;

a part of said gate electrodes adjacent to said gate electrodes driven being kept at a low level.

2. A drive circuit as defined in claim 1, wherein said image display device further comprises at least one dummy electrode arranged on each of both sides of said gate electrodes for preventing leakage luminescence.

3. A drive circuit as defined in claim 1 or 2, wherein said image display device further comprises at least one dummy electrode arranged on each of both sides of said anode electrodes for preventing leakage luminescence.

* * * * *